US010434028B2

(12) United States Patent
Barto

(10) Patent No.: US 10,434,028 B2
(45) Date of Patent: Oct. 8, 2019

(54) STAIRWAY STEP AID

(71) Applicant: Debra L. Barto, Lordstown, OH (US)

(72) Inventor: Debra L. Barto, Lordstown, OH (US)

( * ) Notice: Subject to any disclaimer, the term of this patent is extended or adjusted under 35 U.S.C. 154(b) by 0 days.

(21) Appl. No.: 15/168,626

(22) Filed: May 31, 2016

(65) Prior Publication Data

US 2016/0346157 A1 Dec. 1, 2016

Related U.S. Application Data

(60) Provisional application No. 62/167,775, filed on May 28, 2015.

(51) Int. Cl.

| | |
|---|---|
| ***A61G 3/06*** | (2006.01) |
| ***A61G 5/14*** | (2006.01) |
| ***A61H 3/00*** | (2006.01) |
| ***E04F 11/02*** | (2006.01) |
| *E04F 11/035* | (2006.01) |

(52) U.S. Cl.

CPC ..... *A61H 3/00* (2013.01); *E04F 11/02* (2013.01); *A61G 3/06* (2013.01); *A61G 5/14* (2013.01); *A61H 2003/001* (2013.01); *A61H 2201/0107* (2013.01); *A61H 2201/0192* (2013.01); *A61H 2205/102* (2013.01); *E04F 11/035* (2013.01)

(58) Field of Classification Search

CPC ..... A61G 1/1096; A61G 5/14; A61G 5/1059; A61G 1/1059; A61G 3/06; A61G 3/063; A61G 3/066; A61G 3/067; A61H 2201/0157; A61H 2003/001; A61H 1/0262; A61H 1/0237; A61H 1/024; A61H 2201/0107; A61H 2205/102; A61H 2201/0192; A61H 3/00; E04F 11/035; E04F 11/02

USPC ..... 135/65, 66

See application file for complete search history.

(56) References Cited

U.S. PATENT DOCUMENTS

| | | | | |
|---|---|---|---|---|
| 2,889,842 | A * | 6/1959 | McCauley | A61H 3/00 135/65 |
| 3,229,788 | A * | 1/1966 | Booth | A61G 3/06 182/148 |
| 3,331,529 | A * | 7/1967 | Slapnik | B65D 21/0213 206/508 |
| 3,407,899 | A * | 10/1968 | Delafrange | A47C 3/34 182/20 |
| 3,421,529 | A * | 1/1969 | Vestal | A61H 3/00 135/67 |
| 3,669,494 | A * | 6/1972 | Lohmeyer | A47C 5/12 297/248 |

(Continued)

*Primary Examiner* — Phi D A

(74) *Attorney, Agent, or Firm* — Tucker Ellis LLP; Heather M. Barnes

(57) ABSTRACT

A step aid device has a series of support structures positioned on a flight of stairs to assist a user with a lower leg injury to climb the stairs. A first support structure may be disposed on a first plane. The first support structure has a first side, a second side oppositely disposed from the first side, and a perimeter disposed between the first side and the second side. A second support structure may be disposed on a second plane. The second support structure has a first side, a second side oppositely disposed from the first side, and a perimeter disposed between the first side and the second side. The second support structure the second plane may be offset from the first plane.

7 Claims, 7 Drawing Sheets

(56) References Cited

U.S. PATENT DOCUMENTS

| | | | | | |
|---|---|---|---|---|---|
| 4,844,199 | A * | 7/1989 | Nimz | A61H 3/00 | 182/106 |
| 4,971,510 | A * | 11/1990 | Houle | A61G 3/063 | 180/326 |
| 5,354,247 | A * | 10/1994 | Wilkinson | A47C 3/20 | 206/505 |
| 5,355,904 | A * | 10/1994 | Wallum | A61H 3/00 | 135/65 |
| 5,357,876 | A * | 10/1994 | Kniefel | A47C 12/02 | 108/64 |
| 5,651,753 | A * | 7/1997 | Wilkinson | A63B 23/0458 | 482/51 |
| 5,924,249 | A * | 7/1999 | Kroll | E04F 11/0201 | 52/183 |
| 5,957,146 | A * | 9/1999 | Corey | A61H 3/00 | 135/65 |
| 6,478,374 | B1 * | 11/2002 | Sinoway | A47C 3/04 | 297/239 |
| 6,524,355 | B1 * | 2/2003 | Jenkins | A63B 23/0458 | 48/52 |
| 7,500,818 | B1 * | 3/2009 | Johnson | A61G 3/06 | 414/546 |
| 8,181,739 | B2 * | 5/2012 | Genova | E04F 11/00 | 182/151 |
| 2003/0038518 | A1 * | 2/2003 | Williams | A61G 5/14 | 297/330 |
| 2011/0240076 | A1 * | 10/2011 | Hateley | A61H 3/0244 | 135/66 |
| 2014/0326521 | A1 * | 11/2014 | Hacikadiroglu | A61G 5/061 | 180/8.2 |
| 2015/0290058 | A1 * | 10/2015 | Panzer | B66F 3/28 | 403/109.6 |
| 2018/0311091 | A1 * | 11/2018 | Lykkegaard | A61G 5/1059 | |

* cited by examiner

STAIRWAY STEP AID

This application claims priority to U.S. Ser. No. 62/167,775, entitled Stairway Step Aid, filed May 28, 2015, which is incorporated herein by reference.

BACKGROUND

Injuries and procedures to lower limbs require patients to reduce the amount of weight or pressure put on those limbs. In some instances, patients may be required to put no weight on those limbs for a certain amount of time. Mobility with regard to stairs easily becomes an issue. Getting up and down a flight of stairs in a home or building can be difficult. There may be risk of putting pressure on the affected lower limb or falling. There is a need in the art to provide a device and method for providing a patient with means to climb and descend stairs and simultaneous reduce the amount of weight or pressure placed on an affected limb.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

In one implementation a step aid device has a series of support structures positioned on a flight of stairs to assist a user with a lower leg injury to climb the stairs. A first support structure may be disposed on a first plane. The first support structure has a first side, a second side oppositely disposed from the first side, and a perimeter disposed between the first side and the second side. A second support structure may be disposed on a second plane. The second support structure has a first side, a second side oppositely disposed from the first side, and a perimeter disposed between the first side and the second side. The second support structure the second plane may be offset from the first plane.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

What is disclosed herein may take physical form in certain parts and arrangement of parts, and will be described in detail in this specification and illustrated in the accompanying drawings which form a part hereof and wherein.

DETAILED DESCRIPTION

Figure 1:
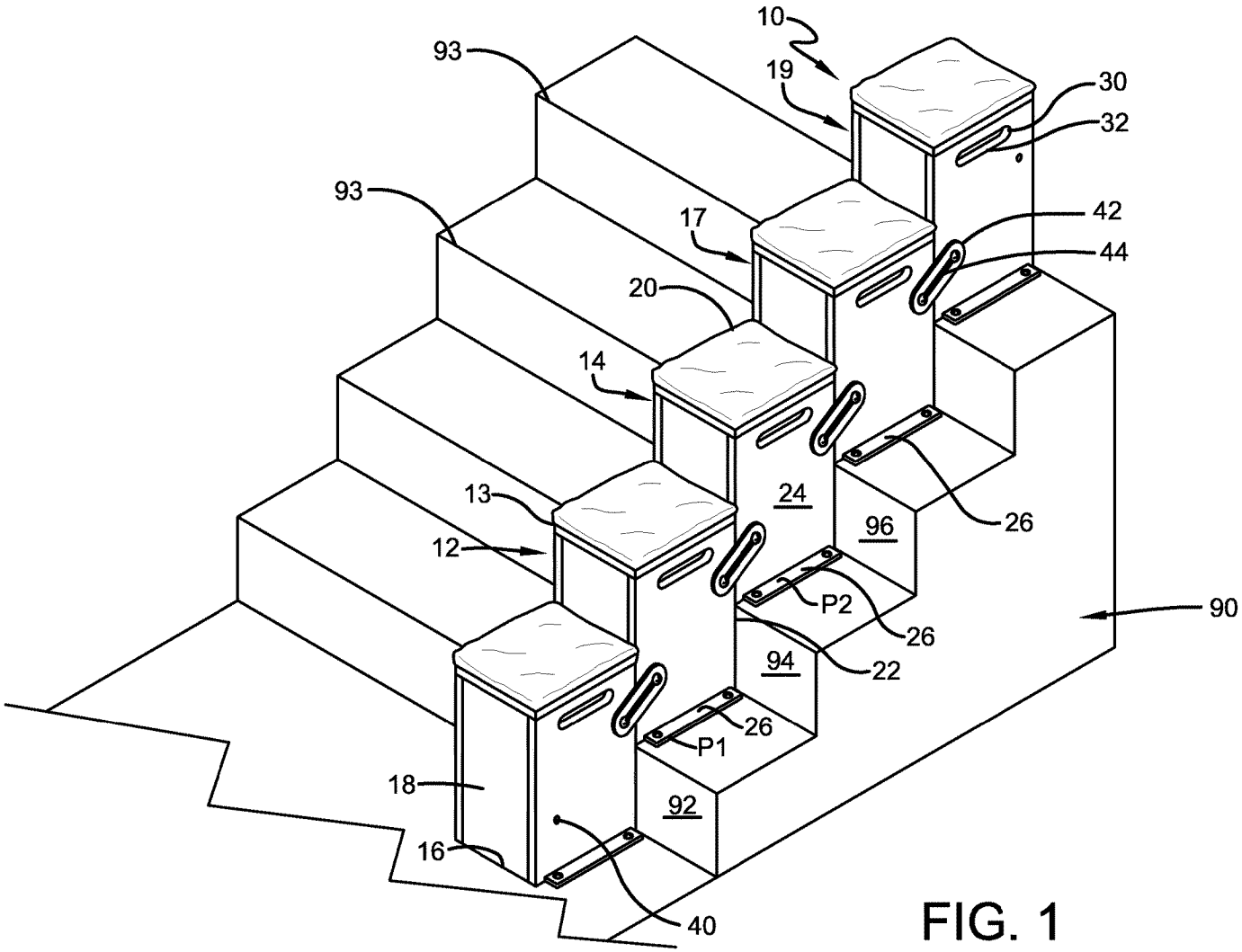
FIG. 1 is a perspective view of one implementation of the present invention.
Figure 3:
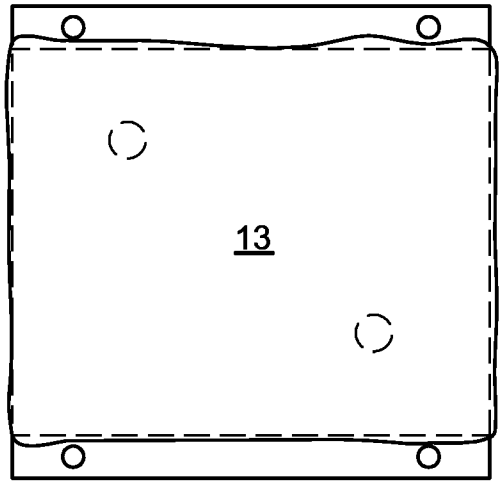
FIG. 3 is a top view of the component shown in FIG. 2.
Figure 2:
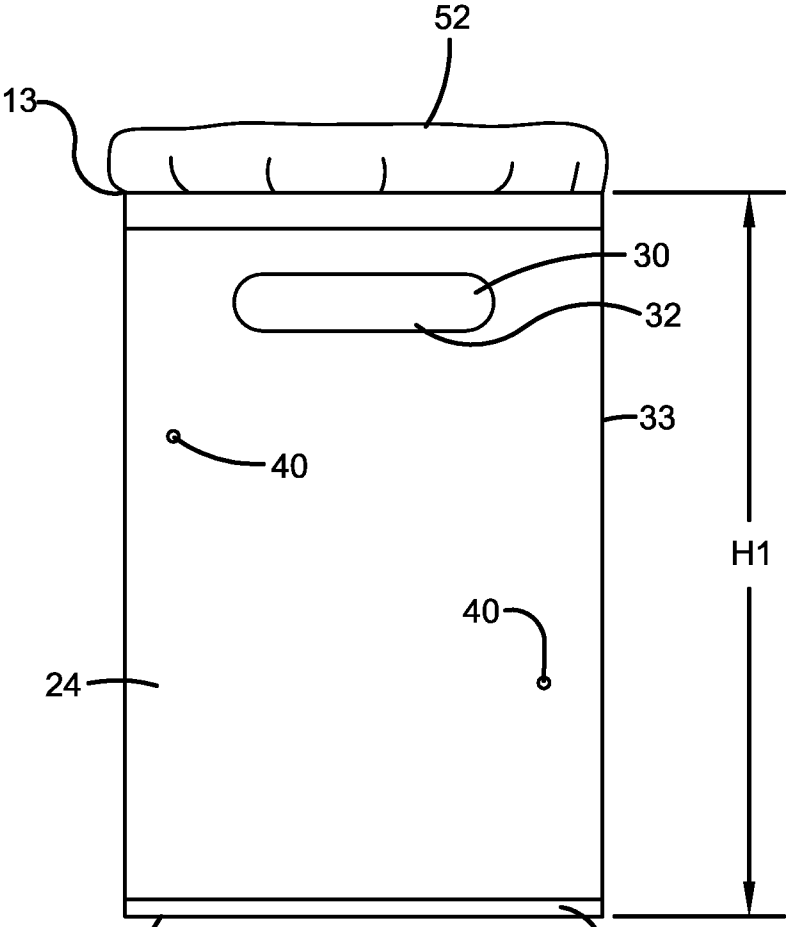
FIG. 2 is a side elevational view of one component of one implementation of the present invention.
Figure 4:
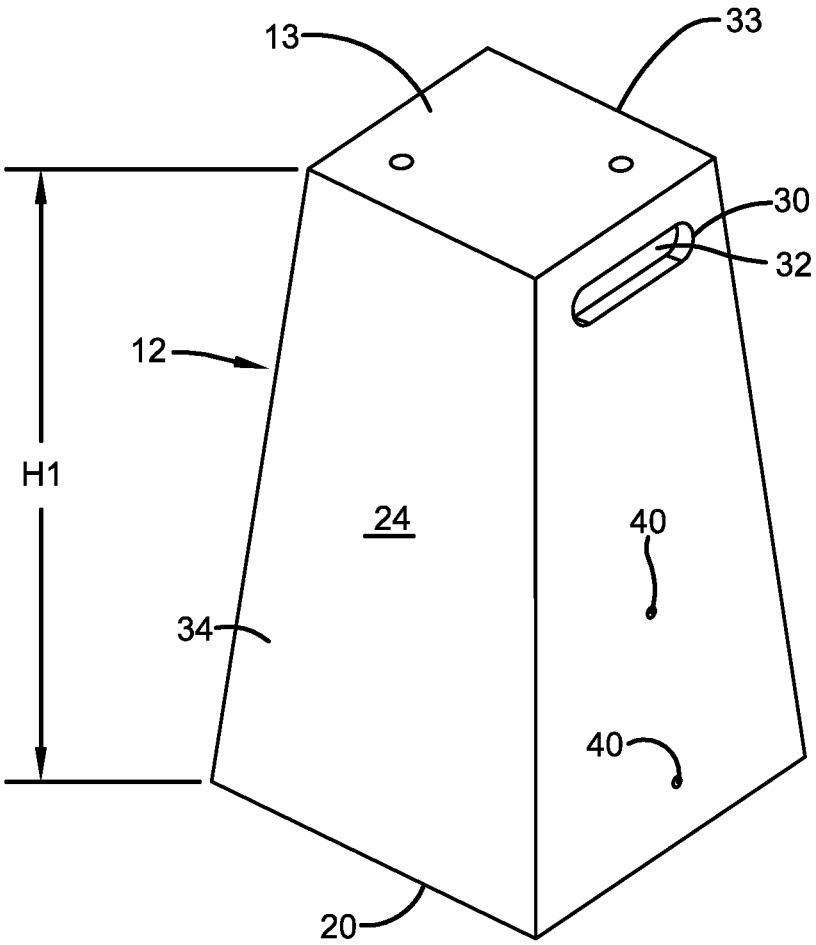
FIG. 4 is a perspective view of another implementation of the present invention.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

With respect to FIGS. 1-6, a step device 10 now described enables a person to have a sturdy and safe place to position his or her knee 102 of an affected leg 100 so that a nonaffected leg 110 may be lifted to a next step safely. The step device 10, in essence, may replace a person's lower leg from an underlying surface, such as a stair, to the person's knee 102.

The step device 10 may be utilized with at least one and in some instances, a flight of stairs 90 comprising two or more stairs 92, 94. The step device 10 may be comprised of at least a first support structure 12 or plurality of support structures, which may include the first support structure, a second support structure 14, a third support structure, and a fourth support structure 16. The plurality of support structures may be placed in series such that one support structure 12 may positioned on a single stair 92.

The first support structure 12 may have a first side 13 and a second side 16 oppositely disposed from the first side 13. A perimeter 18 is disposed between the first side 13 and the second side 16. The first support structure 12 and the second support structure 14 may take any shape chosen in accordance with sound engineering judgment. By way of non-limiting examples, the first support structure 12 and the second support structure 14 may be rectangular, triangular, cylindrical or any polygonal shape. Further, each of the support structures may be solid or at least partially hollow. The first support structure is disposed on a first plane P1 associated with an underlying surface such as a stair 92. The second support structure 14 may be placed in series relative to the first support structure 12. The second support structure 14 may have a first side 20 and a second side 22 oppositely disposed from the first side 20. The second support structure 14 may also have a perimeter 24 disposed between the first side 20 and the second side 22. The second support structure 14 may be disposed on a second plane P2 of an underlying surface, such as a second stair 94. As such, it should be understood that the second plane P2 is offset from the first plane P1.

In other exemplary implementations, the support structures 12, 14, 17, 19 may have a handle 30. The handle 30 may take any form chosen with sound engineering judgment. As show in the FIGURES, the perimeter 18, 24 may have a slot 32 defined therein to form the handle 30. In another implementation, the first side 14, 20 may have an extended lip (not shown) for a user to grip and carry the support structure.

Figure 5:
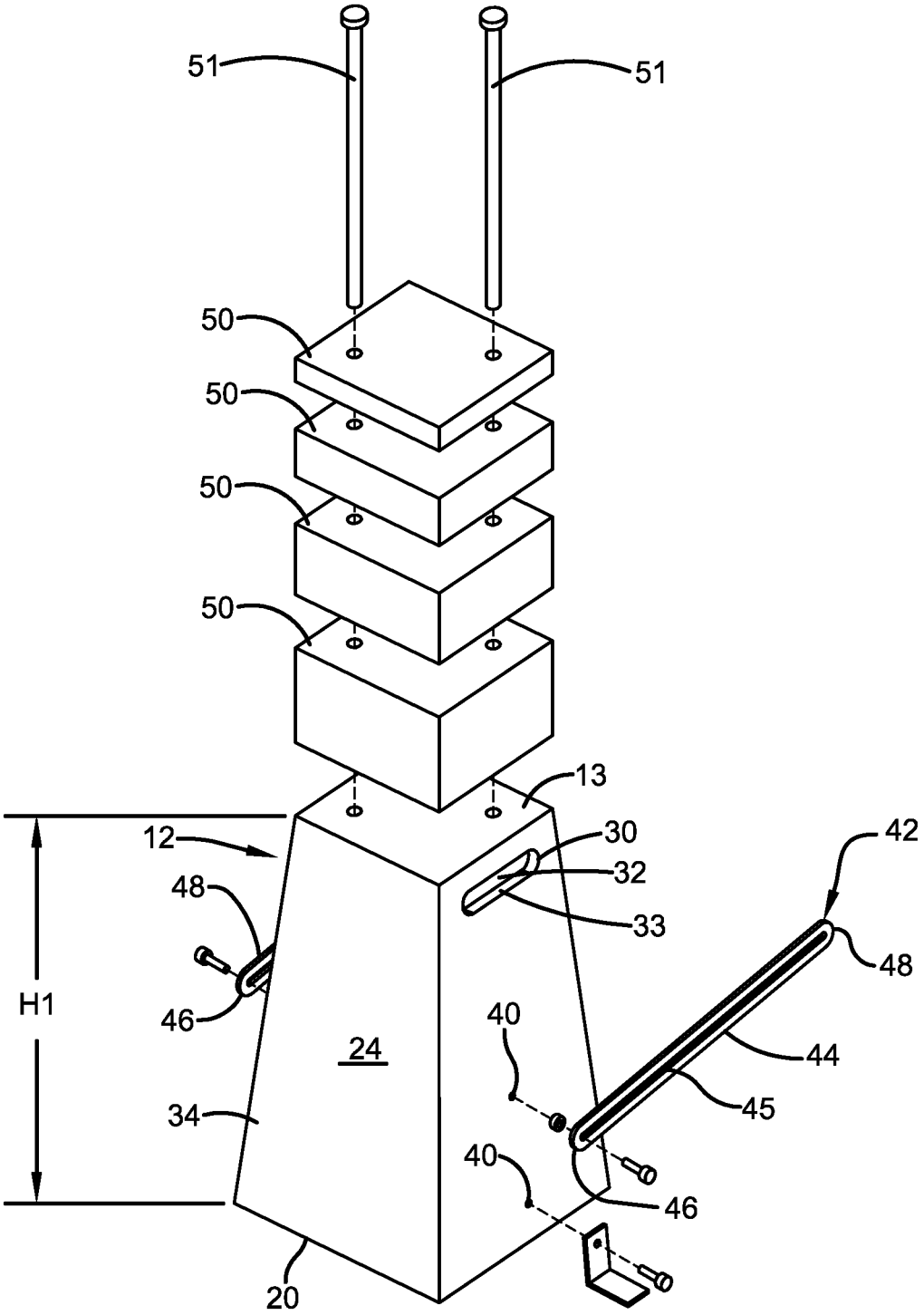
FIG. 5 is an exploded perspective view of another implantation of the present invention.
Figure 6A:
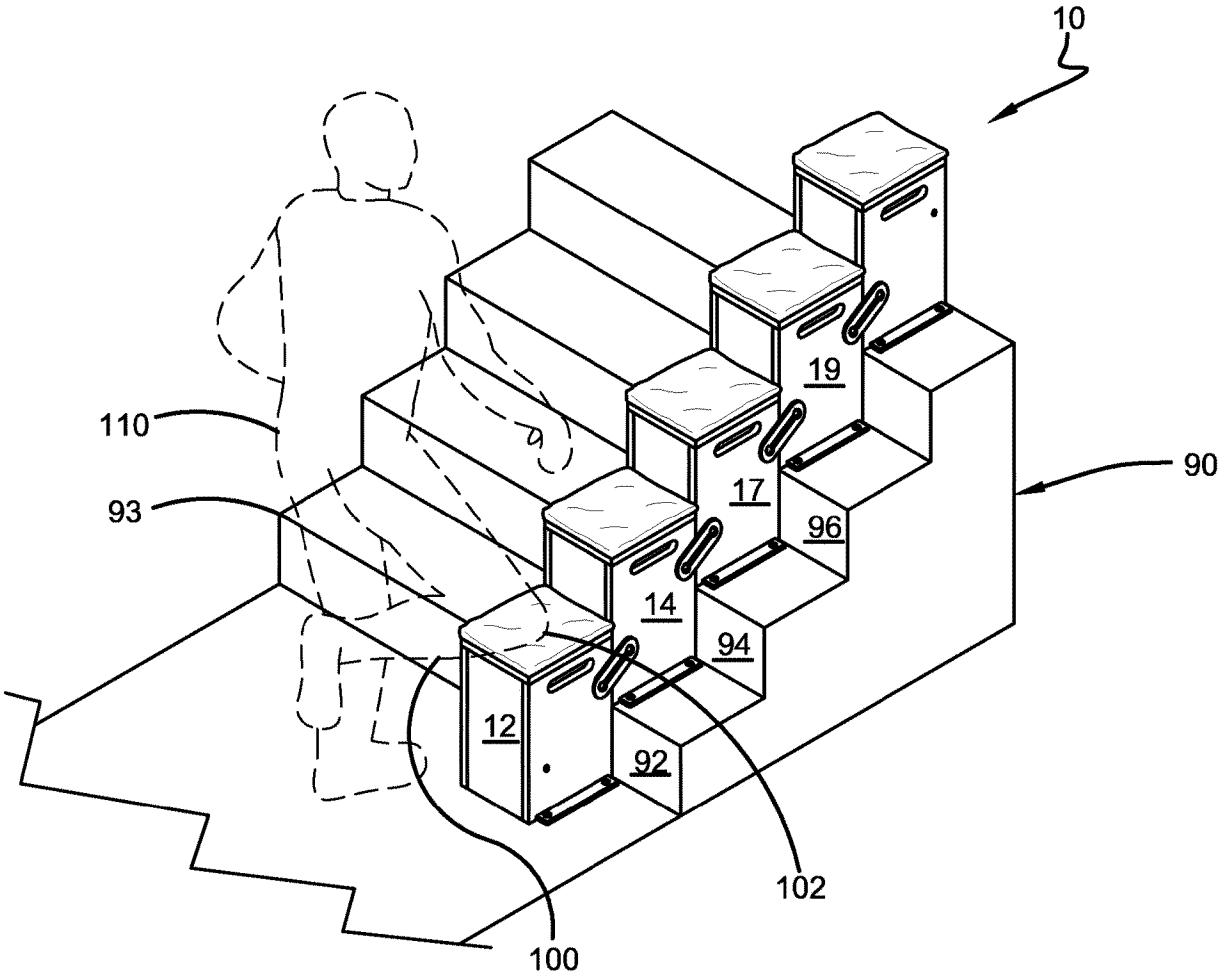
FIGS. 6*a*-6*c* illustrates one implementation of the present invention in use.
Figure 6B:
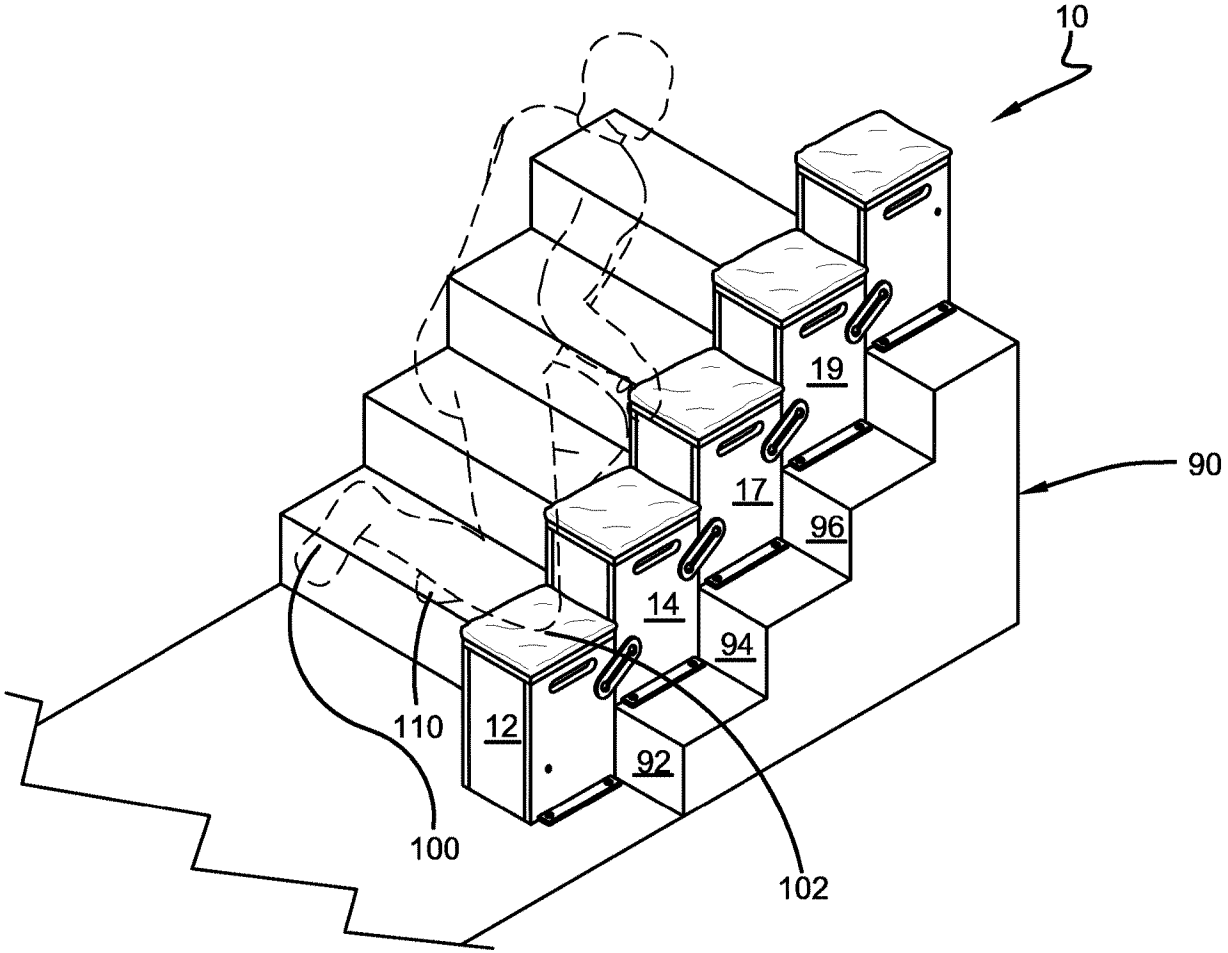
Figure 6C:
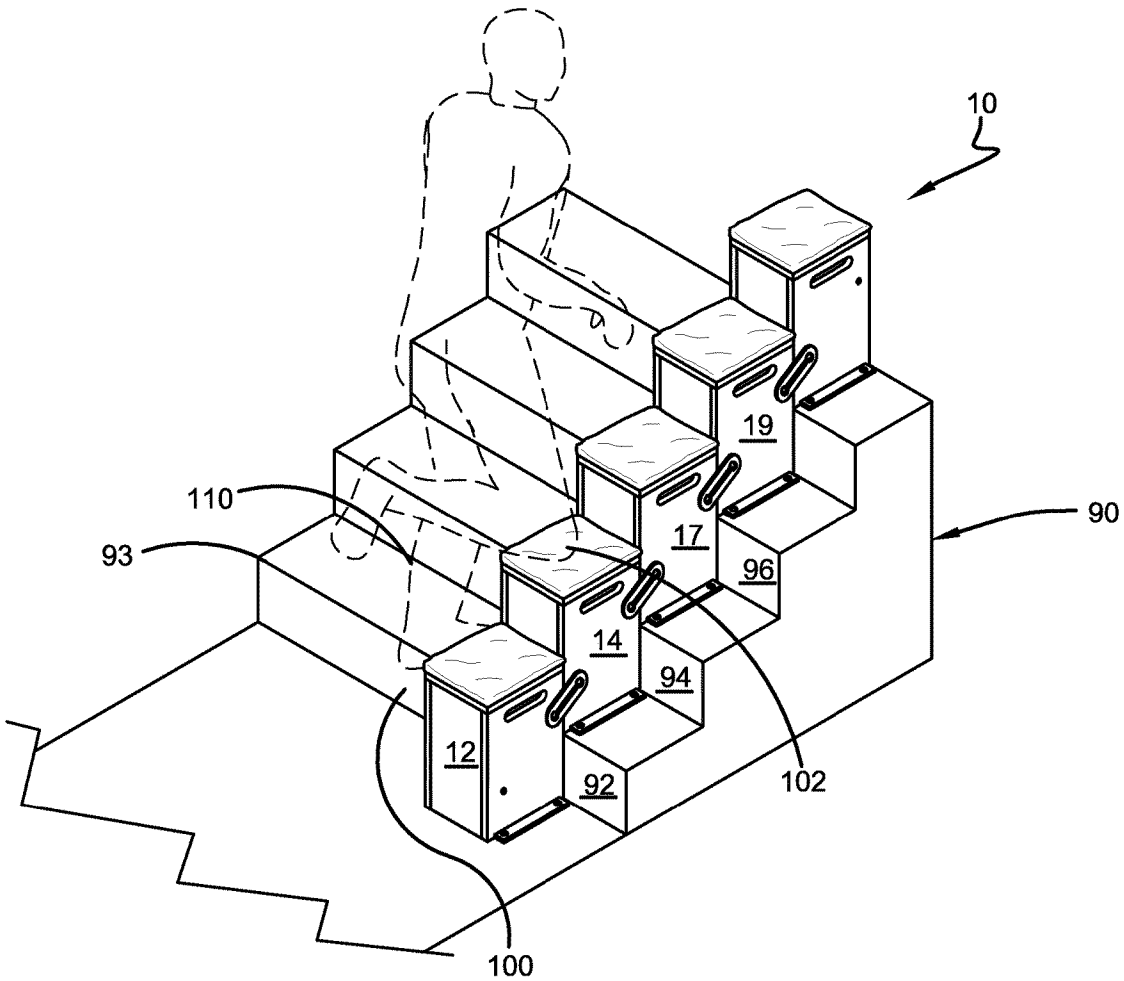

In yet another implementation, the first support structure 12 and the second support structure 14 may each have at least one outwardly extending flange 26 adjacent to the second side 16, 22 configured to secure the first support structure 12 and the second support structure 14 to the associated stairs 92, 94. The outwardly extending flange 26 may be of any length chosen with sound engineering judgment. For example, the outwardly extending flange 26 could extend substantially along the length of a side of a rectangular support structure or it could extend along a partial length of a side of a rectangular support structure. Yet in another example, the outwardly extending flange 26 may take the form of a bracket 25 as shown in FIG. 5. Further, the outwardly extending flange 26 may be positioned anywhere about the second side 16, 22 of the support structure 12, 14, such as the left side, right side, front or rear.

The perimeter 18, 24 of each support structure may have a rear portion 33 and a front portion 34. The rear portion 33 may be substantially perpendicular to a nosing 93 of the stairs, 92, 94, 96. The front portion 34 may be angled toward the rear portion 33 in order to prevent tipping. The angle may be about two degrees. The angle may be as much as thirty degrees.

In further implementations, the second support structure 14 may be interconnected with the first support structure 12. The perimeter 18, 24 may have holes 40 defined therein. A fastener 42, such as a connector 44, has a first end 46 and a second end 48. The connector 44 may have a slot 45 defined therein. The first end 46 of the connector may be attached or positioned by a bolt, screw or other fastener in one hole 40 of the perimeter 18 of the first support structure. The second end 48 of the connector 44 may be attached or positioned in one hold of the perimeter 24 of the second support structure 14. In one implementation, the second end 48 may be positioned at a higher elevation than the first end 46. Utilization of the connector 44 with the defined slot enables adjustability of the first structure 14 relative to the second structure for purposes of accommodating flights of stairs 90 of different sizes. In other words, screws or the like, when used to secure the first end 46 and the second 48, may be selectively positionable anywhere along the slot 45 or the fasteners may be slightly raised such that heads of the fasteners float in the slot 45 of the connector as the support structures 12, 14 are positioned on the stairs 92, 94. This provides angular and elevational adjustment for the second support structure 14 relative to the first support structure 12.

In another implementation, the first support structure 12 has a first height H1. The step device 10 may comprise at least one or more spacers 50 operatively connected to the first side 13 of the first support structure 12. The spacer 50 has a height to adjust the overall height of the first support structure 12. Spacers 50 may be in a variety of heights, widths and lengths to properly fit the first side 13 of the first support structure 12. A user may selectively use as many spacers 50 as necessary such that the height H1 of the first support structure is substantially equal to about the height from the underlying surface, the stair 92, and the user's knee 102. The spacers 50 may be secured to the support structures 12, 14 with any fastener 51, such as bolts, screws, etc. For comfort, a cushion 52 may be positioned on the first side 13 of the first support structure 12 or on top of a spacer 50.

In another implementation as shown in FIG. 5, the first support structure 12 and the second support structure 14 may have a tapered configuration from top to bottom such that they may be nested and stackable. Further, the stepping device may further comprise a pin to selectively secure the first support structure 12 and the second support structure together for storage 14. The pin can be inserted through holes defined on the first side 13.

In use, a user positions a knee 102 of the affected leg 100 on the first side 13 of the first support structure 12. The user then bears body weight on the opposing, nonaffected leg 110 taking weight off the knee 102. The opposing, nonaffected leg 110 is in proximity to the first support structure 12 either on the same stair 92 as the first support structure 12 or on the stair 94 above or the step below the support structure 12. After the user has placed weight on the opposing unaffected leg, the user positions the knee on the first side 20 of the second support structure 14. In order to further complete climbing stairs, the user again bears body weight on the body weight on the opposing leg 110. These steps are repeated until the stairs are climbed. Depending upon the comfort of the user, the user can move the nonaffected leg 110 to the next step and then move the knee 102 of the affected leg 100 to the next support structure such that most of the weight is placed on the unaffected leg 110. However in some situation, the knee 102 of the affected leg 100 may need to bear more weight as the nonaffected leg 110 moves between stairs.

It is also contemplated to be within the scope of the invention to use the step device 10 to stand at a bathroom sink, kitchen sink, stove or any other location for a protracted period of time.

The step device may be made from any material chosen with sound engineering judgment. By way of nonlimiting example, the step device, as a whole, or a portion thereof may be made of any of the following materials or combination of plastic or metal. This could include without limitation steel, aluminum, polyvinyl chloride or other sturdy polymer.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A step aid device, comprising:

a first support structure having a first height and being disposed on a first plane, the first support structure having a first side, a second side oppositely disposed from the first side, and a perimeter disposed between the first side and the second side, the first plane being a first stair, the first side of the first support structure sized to fit an associated user's knee, the first side of the first support structure being substantially planar and free of obstructions that would interfere with uninhibited placement of the user's knee on the first side of the first support structure;

at least one spacer having a first spacer side separated from a second spacer side by a second height, the first spacer side and the second spacer side being substantially planar, the first spacer side configured to be connected to the first side of the first support structure to adjust the first height of the first support structure by the second height, and the adjusted first height of the first support structure being substantially equal to the height from the first planar surface and the associated user's knee;

a second support structure disposed on a second plane, the second support structure having a first side, a second side oppositely disposed from the first side, and a perimeter disposed between the first side and the second side, the second support structure the second plane being offset from the first plane, the second plane being a second stair, the first side of the second support structure positioned to receive an associated user's knee, the first side of the second support structure being substantially planar and free of obstructions that would interfere with uninhibited placement of the user's knee on the first side of the second support structure; and an elongated connector having an elongated slot defined therein, the connector having a first end operably and rotatably connected to the first support structure through a first fastener and a second end operably and rotatably connected to the second support structure through a second fastener, the first support structure elevationally and angularly adjustable relative to the second support structure through the elongated connector, the first fastener and/or the second fastener selectively positionable within the elongated slot.

2. The step aid device of claim 1, wherein the first support structure and the second support structure each have at least one outwardly extending flange adjacent to the second side configured to secure the first support structure and the second support structure to an associated underlying surface.

3. The step aid device of claim 1, wherein the perimeter of each support structure has a rear portion and a front portion, the rear portion being substantially perpendicular to an associated nosing of a stair and the front portion being angled toward the rear portion.

4. The step aid device of claim 1, the first side of the first support structure and the first side of the second support structure each have at least one hole defined therein, where the first support structure and the second support structure are nested and stackable, a pin to selectively secure the first support structure and the second support structure together via the at least one hole defined in the first side of the first support structure and the first side of the second support structure.

5. The step aid device of claim 1, further comprising a cushion operatively connected to the first side of the first support structure.

6. The step aid device of claim 1, wherein the perimeter of the first support structure has a slot defined therein to a handle.

7. A step aid device for a flight of stairs, the flight of stairs comprising a first stair, a second stair, a third stair and a fourth stair, the step aid device comprising:

a plurality of support structures, each support structure comprising:

a first side sized to fit an associated user's knee, the first side of the first support structure being substantially planar and free of obstructions that would interfere with uninhibited placement of the user's knee on the first side of the support structure, a second side oppositely disposed from the first side, and a perimeter disposed between the first side and the second side;

each of the support structures disposed on one of the first stair, second stair, third stair, and fourth stair;

each of the support structures having a selectively adjustable height, each of the support structures being angularly and elevationally interconnected by an elongated connector having an elongated slot defined therein, the connector having a first end operably and rotatably connected to one of the plurality of support structures through a first fastener and a second end operably and rotatably connected to another one of the plurality of support structures through a second fastener, the first fastener and/or the second fastener selectively positionable within the elongated slot;

the first side of one or more of the plurality of support structures having at least one hole defined therein, a pin to selectively secure one of the plurality of support structures to another one of the plurality of support structures;

the first side and the second side having a first height, one or more spacers each having a first spacer side separated from a second spacer side by a second height, the first spacer side and the second spacer side being substantially planar, the first spacer side configured to be connected to the first side of one of the plurality of support structure to adjust the first height, the adjusted first height of the one of the plurality of support structures being substantially equal to the height from the first second surface and the associated user's knee; and the perimeter of one of the plurality of support structures having a slot defined therein to form a handle.

* * * * *